US009921524B2

(12) United States Patent
Sasaki et al.

(10) Patent No.: US 9,921,524 B2
(45) Date of Patent: Mar. 20, 2018

(54) IMAGE FORMATION APPARATUS AND METHOD FOR CONTROLLING IMAGE FORMATION APPARATUS

(71) Applicant: Konica Minolta, Inc., Tokyo (JP)

(72) Inventors: Satoru Sasaki, Toyokawa (JP); Yumiko Izumiya, Hachioji (JP); Hidenori Mine, Tachikawa (JP); Takumi Shirakuma, Tokyo (JP); Kosuke Sasaki, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/370,758

(22) Filed: Dec. 6, 2016

(65) Prior Publication Data

US 2017/0168427 A1 Jun. 15, 2017

(30) Foreign Application Priority Data

Dec. 9, 2015 (JP) ..... 2015-240281

(51) Int. Cl.
*G03G 15/16* (2006.01)

(52) U.S. Cl.
CPC ..... *G03G 15/161* (2013.01); *G03G 15/1615* (2013.01); *G03G 2215/00143* (2013.01); *G03G 2215/00156* (2013.01); *G03G 2215/0135* (2013.01)

(58) Field of Classification Search
None
See application file for complete search history.

(56) References Cited

U.S. PATENT DOCUMENTS

2005/0081889 A1* 4/2005 Nakano ..... G03G 15/161 134/6
2012/0237268 A1* 9/2012 Sakashita ..... G03G 15/0189 399/258
2014/0270840 A1* 9/2014 Kudo ..... G03G 15/161 399/101
2014/0356043 A1* 12/2014 Tokuda ..... G03G 21/105 399/358

FOREIGN PATENT DOCUMENTS

JP 06056294 A 3/1994
JP 2009031613 A 2/2009

* cited by examiner

*Primary Examiner* — Thomas Giampaolo, II
(74) *Attorney, Agent, or Firm* — Lucas & Mercanti, LLP

(57) ABSTRACT

An image formation apparatus comprising: a belt member suspended by a plurality of supporting rotating bodies and thus rotating; a cleaning member removing toner adhering to the belt member; a tray receiving waste toner removed from the belt member by the cleaning member; a vibration mechanism vibrating the tray to move the waste toner toward a lower side of the tray; a steering control mechanism to perform movement control to move the belt member in an axial direction of the supporting rotating bodies while the belt member rotates; and a vibration adjustment mechanism to change a manner of vibration of the vibration mechanism, based on the movement control by the steering control mechanism.

6 Claims, 6 Drawing Sheets

IMAGE FORMATION APPARATUS AND METHOD FOR CONTROLLING IMAGE FORMATION APPARATUS

This application is based on Japanese Patent Application No. 2015-240281 filed with the Japan Patent Office on Dec. 9, 2015, the entire content of which is hereby incorporated by reference.

BACKGROUND OF THE INVENTION

Field of the Invention

The present invention relates to an image formation apparatus and particularly to an image formation apparatus having a steering control function.

Description of the Related Art

An image formation apparatus includes around an image carrier a charging device, an exposure device, a developer, a transfer device, a cleaning device, a diselectrifying lamp, etc. The charging device charges the image carrier uniformly. Subsequently, the exposure device forms an electrostatic latent image on the image carrier. The developer develops the electrostatic latent image into a toner image. The transfer device transfers the toner image to a transported transferring material. The cleaning device removes residual toner on the image carrier. The diselectrifying lamp removes the electric charge of the image carrier. Image formation is performed by this series of steps.

In the image formation, an endless belt may be used as the image carrier or an intermediate transfer body. The endless belt (hereinafter also simply referred to as a "belt") is tensioned and thus engaged on a plurality of rollers having at least a drive roller and a tensioning roller, and thus driven.

However, depending on the rollers' parallelism accompanying their arrangement, the rollers' precision as a cylinder, a difference between the opposite lateral edges of the belt in circumferential length, etc., there is a possibility that a phenomenon occurs in which the belt moves in a direction having a right angle relative to the direction of transportation (i.e., in the roller's axial direction), i.e., the belt meanders.

When the meandering phenomenon occurs, an image which is formed on the belt or an image which is transferred on the belt is offset and a satisfactory image cannot be obtained.

Accordingly, Japanese Laid-Open Patent Publication No. 6-56294 proposes, as a technique to control the meandering of the belt, an intermediate transfer unit which has a steering control function to control the belt's axial movement by moving one end of a roller that imparts tension to the belt to vary a distance which the belt's end travels.

Furthermore, Japanese Laid-Open Patent Publication No. 2009-31613 proposes a system in which, in an intermediate transfer unit having a steering control function, in order to remove residual toner on an intermediate transfer belt, a cleaning blade abuts against the intermediate transfer belt.

SUMMARY OF THE INVENTION

However, in the system in which the cleaning blade abuts against the intermediate transfer belt, waste toner scraped off remains on a toner tray. When the waste toner which remains on the toner tray is accumulated, there is a possibility that the waste toner may return to the intermediate transfer belt and smear an image, and accordingly, the waste toner needs to be removed as appropriate. Accordingly, there is provided a mechanism for vibrating the toner tray, as timed in a fixed manner, to collect waste toner to obtain a stable output image.

However, in the intermediate transfer unit which has the steering control function, when the position of the intermediate transfer roller is moved by steering control, the cleaning blade abuts against the belt in a varying amount (or with a varying pressure). This variation may vary the amount of toner scraped off by the cleaning blade and accordingly increase the amount of waste toner. As such, it is necessary to adjust the waste toner collection system according to the steering control, however, this is not considered in any of the above documents.

The present invention has been made to address the above issue, and contemplates an image formation apparatus having a steering control function, that can obtain a stable output image, and a method of controlling the image formation apparatus.

To achieve at least one of the above mentioned objects an image forming apparatus reflecting one aspect of the present invention comprises: a belt member suspended by a plurality of supporting rotating bodies and thus rotating; a cleaning member removing toner adhering to the belt member; a tray receiving waste toner removed from the belt member by the cleaning member; a vibration mechanism vibrating the tray to move the waste toner toward a lower side of the tray; a steering control mechanism to perform movement control to move the belt member in an axial direction of the supporting rotating bodies while the belt member rotates; and a vibration adjustment mechanism to change a manner of vibration of the vibration mechanism, based on the movement control by the steering control mechanism.

Preferably, the vibration adjustment mechanism changes as the manner of vibration at least any one of a vibration frequency and a vibration amplitude applied to vibrate the tray.

Preferably, the vibration adjustment mechanism changes the manner of vibration of the vibration mechanism based on at least any one of the movement control by the steering control mechanism, an image writing region's size, an image writing density, and an amount travelled by the belt member.

Preferably, the vibration mechanism includes an impinging member to impinge on the tray, with a fulcrum position serving as a fulcrum, to vibrate the tray. The vibration adjustment mechanism adjusts the impinging member's fulcrum position.

Preferably, the steering control mechanism includes a cam to adjust at least one of the plurality of supporting rotating bodies positionally, and a motor for driving the cam to perform the movement control. The vibration adjustment mechanism includes a moving roller provided movably to set a fulcrum position, and at least one gear coupled between the moving roller and the motor for moving the moving roller as the motor is driven.

According to one aspect, a method for controlling an image formation apparatus having a belt member suspended by a plurality of supporting rotating bodies and thus rotating, a cleaning member removing toner adhering to the belt member, and a tray receiving waste toner removed from the belt member by the cleaning member, the method comprising: imparting vibration to the tray to move waste toner toward a lower side of the tray; performing movement control to move the belt member in an axial direction of the supporting rotating bodies while the belt member rotates; and changing a manner of vibration, based on the movement control, to impart vibration.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment will now be described in detail with reference to the drawings. In the figures, identical or corresponding components are identically denoted and will not be described repeatedly.

<A. Outline of General Configuration>

Figure 1:
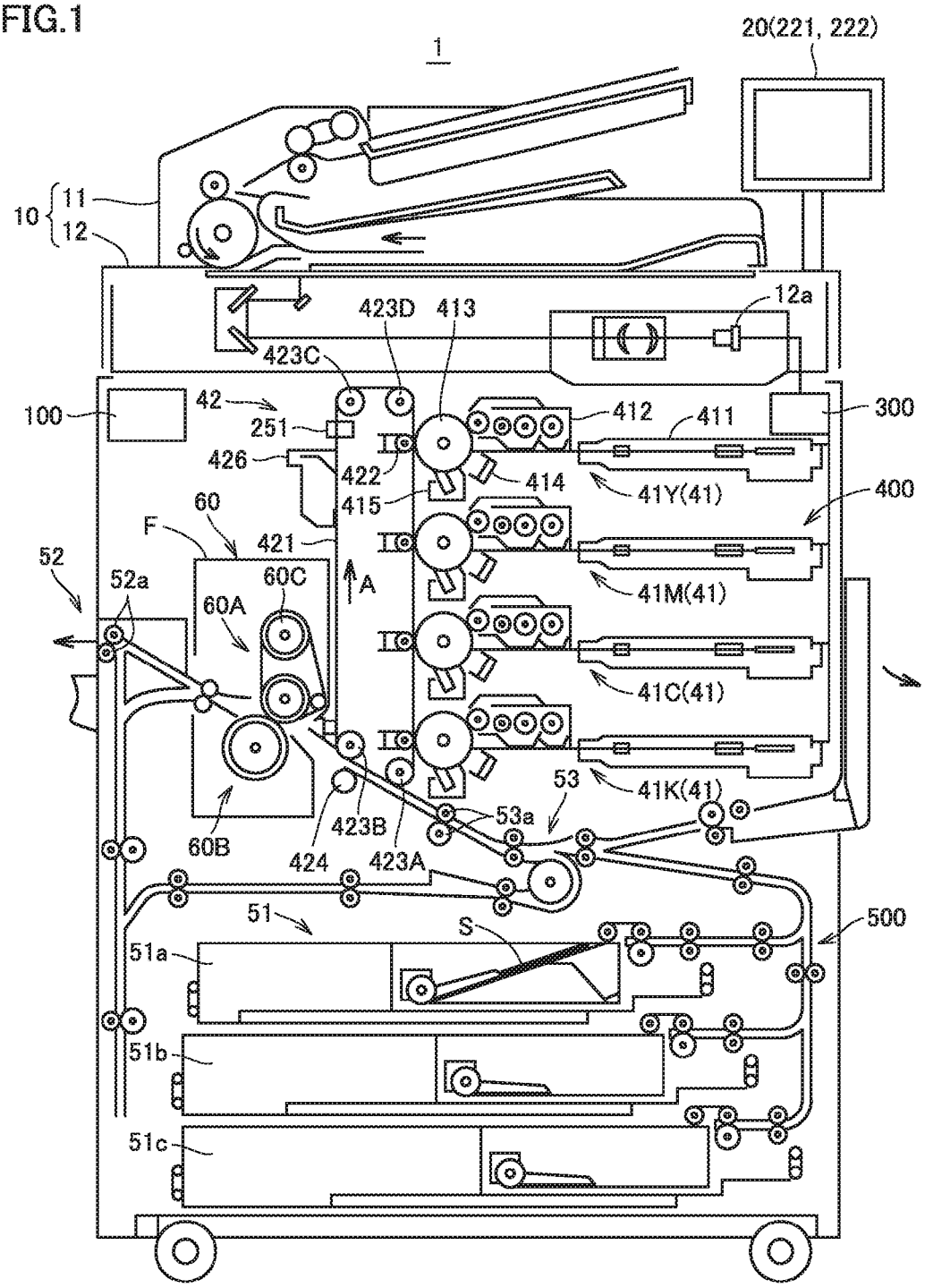
FIG. 1 is a diagram schematically showing a general configuration of an image formation apparatus 1 based on an embodiment.

FIG. 1 is a diagram schematically showing a general configuration of an image formation apparatus 1 based on an embodiment.

With reference to FIG. 1, image formation apparatus 1 is a color image formation apparatus of an intermediate transfer system utilizing electrophotography process technology. More specifically, image formation apparatus 1 transfers color toner images of Y (yellow), M (magenta), C (cyan), and K (black), respectively, each formed on a photoreceptor drum 413, to an intermediate transfer belt 421 (i.e., primary transfer) to superimpose the toner images of the 4 colors, one on another, on intermediate transfer belt 421, and subsequently transfers the superimposed toner images to a sheet S (i.e., secondary transfer) to form an image.

Furthermore, image formation apparatus 1 adopts a tandem system in which photoreceptor drums 413 corresponding to the 4 colors of YMCK are disposed in series in a direction in which intermediate transfer belt 421 travels to allow each color toner image to be transferred to intermediate transfer belt 421 successively through a single procedure.

Image formation apparatus 1 includes an image reading portion 10, an operation and display portion 20, an image processing portion 300, an image forming portion 400, a sheet transport portion 500, a fixing portion 60, and a control portion 100.

Control portion 100 includes a CPU (Central processing unit), a ROM (Read Only Memory), a RAM (Random Access Memory), etc. The CPU reads a program depending on the contents to be processed from the ROM and develops it in the RAM, and cooperates with the developed program to intensively control an operation of each block of image formation apparatus 1.

Image reading portion 10 is configured including an automatic original sheet feeding device 11 referred to as an ADF (Auto Document Feeder), and an original image scanning device 12 (a scanner), etc.

Automatic original sheet feeding device 11 transports an original that is placed on an original tray by a transport mechanism, and sends it out to original image scanning device 12. Automatic original sheet feeding device 11 can read at once successively images on a large number of originals (including opposite sides) placed on the original tray.

Original image scanning device 12 optically scans an original transported to a contact glass from automatic original sheet feeding device 11 or an original placed on the contact glass, forms an image of the light that is reflected from the original on a light receiving surface of a CCD (Charge Coupled Device) sensor 12*a*, and reads the original's image. Image reading portion 10 generates input image data based on a result of reading by original image scanning device 12. This input image data is subjected to a prescribed image processing in image processing portion 300.

Operation and display portion 20 is configured for example by a touchscreen panel equipped liquid crystal display (LCD) and functions as a display portion 221 and an operation portion 222. Display portion 221 operates in response to a display control signal received from control portion 100 to display various types of operation screens, a state of an image, how each function operates, etc. Operation portion 222 includes various types of operation keys, such as numerical keys and a start key etc. and receives a variety of types of input operations done by the user and outputs an operation signal to control portion 100.

Image processing portion 300 includes a circuit etc. which subjects input image data to digital image processing depending on an initial setting or a user setting. For example image processing portion 300 is controlled by control portion 100 to perform gray level correction based on gray level correction data (a gray level table). Furthermore, image processing portion 300 subjects input image data to gray level correction, and other than that, color correction, shading correction and other various types of correction processes, a compression process etc. Image forming portion 400 is controlled based on the image data that has underwent these processes.

Image forming portion 400 includes image forming units 41Y, 41M, 41C, 41K operative in response to input image data for forming an image by each colored toner of a Y component, an M component, a C component, and a K component, an intermediate transfer unit 42, etc.

Image forming units 41Y, 41M, 41C, 41K for the Y component, the M component, the C component and the K component have a similar configuration. For the sake of illustration and description, common components are identically denoted and when they are distinguished they are denoted by identical reference characters with a letter Y, M, C, or K attached thereto. In FIG. 1, only image forming unit 41Y for the Y component has its constituent components denoted by reference characters and the other image forming units 41M, 41C, 41K have their constituent components undenoted by reference characters.

Image forming unit 41 includes an exposure device 411, a developing device 412, a photoreceptor drum 413, a charging device 414, and a drum cleaning device 415 etc.

Photoreceptor drum 413 is for example a negatively charged organic photoconductor (OPC) having an electrically conductive cylindrical body of aluminum (an elementary tube of aluminum) having a circumferential surface with an undercoat layer (UCL), a charge generation layer (CGL) and a charge transport layer (CTL) successively deposited thereon. The charge generation layer is composed of an organic semiconductor having a charge generating material (e.g., a phthalocyanine pigment) dispersed in a resin binder (e.g., polycarbonate), and is exposed to light by exposure device 411 to generate a pair of a positive charge and a negative charge. The charge transport layer is made of what has a hole transporting material (an electron-donating, nitrogen-containing compound) dispersed in a resin binder (e.g., polycarbonate resin), and transports the positive charge that is generated in the charge generation layer to a surface of the charge transport layer.

Control portion 100 controls a driving current supplied to a motor (not shown) that causes photoreceptor drum 413 to rotate so that photoreceptor drum 413 rotates at a controlled circumferential speed.

Charging device 414 charges a surface of photoconductive photoreceptor drum 413 uniformly to have negative polarity. Exposure device 411 is configured for example by a semiconductor laser and exposes photoreceptor drum 413 to laser light corresponding to an image of each color component. The positive charge generated in the charge generation layer of photoreceptor drum 413 and transported to a surface of the charge transport layer neutralizes a charge of a surface of photoreceptor drum 413 (a negative charge). On a surface of photoreceptor drum 413, an electrostatic latent image of each color component will be formed by a difference in potential from the surroundings.

Developing device 412 is for example of a two-component development system and allows a toner of each color component to adhere to a surface of photoreceptor drum 413 to visualize an electrostatic latent image to thus form a toner image.

Drum cleaning device 415 has a drum cleaning blade etc. sliding in contact with a surface of photoreceptor drum 413 to remove toner remaining on a surface of photoreceptor drum 413 after the primary transfer.

Intermediate transfer unit 42 includes an intermediate transfer belt 421, a primary transfer roller 422, a plurality of drive rollers 423A-423D (also collectively referred to as a drive roller 423), a secondary transfer roller 424, and a belt cleaning device 426 etc.

Intermediate transfer belt 421 is an endless belt and tensioned and thus engaged on the plurality of drive rollers 423 in a loop. At least one of the plurality of drive rollers 423 is a driving roller 423A and the others are driven rollers. When driving roller 423A is rotated by control portion 100, intermediate transfer belt 421 travels in a direction of an arrow A.

Primary transfer roller 422 is disposed on the side of the inner circumferential surface of intermediate transfer belt 421 opposite to photoreceptor drum 413 of each color component. Primary transfer roller 422 is pressed against photoreceptor drum 413 with intermediate transfer belt 421 sandwiched therebetween to form a primary transfer nip for transferring a toner image from photoreceptor drum 413 to intermediate transfer belt 421.

Secondary transfer roller 424 is disposed on the side of the outer circumferential surface of intermediate transfer belt 421, opposite to drive roller 423B disposed downstream of drive roller 423A as seen in a direction in which the belt travels. Secondary transfer roller 424 is pressed against drive roller 423B with intermediate transfer belt 421 sandwiched therebetween to form a secondary transfer nip for transferring a toner image from intermediate transfer belt 421 to sheet S.

When intermediate transfer belt 421 passes the primary transfer nip, toner images on the plurality of photoreceptor drums 413 are successively superimposed on intermediate transfer belt 421 and thus primarily transferred. Specifically, a primary transferring bias is applied to primary transfer roller 422 to impart an electric charge having a polarity opposite to that of the toner to the back side of intermediate transfer belt 421 (a side thereof that abuts against primary transfer roller 422) to electrostatically transfer the toner image to intermediate transfer belt 421.

Subsequently, when sheet S passes the secondary transfer portion, the toner image on intermediate transfer belt 421 is secondarily transferred to sheet S. Specifically, a secondary transferring bias is applied to secondary transfer roller 424 to impart an electric charge having a polarity opposite to that of the toner to the back side of sheet S (a side thereof that abuts against secondary transfer roller 424) to electrostatically transfer the toner image to sheet S. Sheet S with the toner image transferred thereon is transported toward fixing portion 60.

Thus secondary transfer roller 424 and drive roller 423B sandwich intermediate transfer belt 421 to thus form a nip portion. Accordingly, drive roller 423B, secondary transfer roller 424, and intermediate transfer belt 421 will function as a secondary transfer portion which secondarily transfers to sheet S passing through the nip portion the images that are successively transferred from the plurality of photoreceptor drums 413 to intermediate transfer belt 421.

Belt cleaning device 426 has a belt cleaning blade 5 etc. which slides in contact with a surface of intermediate transfer belt 421 to remove toner which remains on a surface of intermediate transfer belt 421 after the secondary transfer portion has done the secondary transfer.

Note that instead of secondary transfer roller 424, a configuration may be adopted in which a secondary transfer belt is tensioned and thus engaged in a loop on a plurality of drive rollers including a secondary transfer roller (a so-called belt-type secondary transfer unit). It is needless to say that this case also allows the above secondary transfer roller to be pressed against drive roller 423B to form a nip portion with intermediate transfer belt 421 sandwiched thereby.

A belt position detection sensor 251 is provided downstream of belt cleaning device 426. Steering control by a steering control mechanism described later is performed based on a result of detection done by belt position detection sensor 251.

Fixing portion 60 has an upper fixing portion 60A having a fixing surface side member disposed on the side of a fixing surface of sheet S (i.e., a surface thereof on which a toner image is formed), a lower fixing portion 60B having a back surface side member disposed on the side of the back surface of sheet S (i.e., a surface thereof opposite to the fixing surface), and a heat source 60C etc. The back surface side support member is pressed against the fixing surface side member to form a fixing nip portion which pinches and thus transports sheet S.

Fixing portion 60 receives sheet S that has a toner image secondarily transferred thereon and is thus transported, and fixing portion 60 heats and pressurizes sheet S at the fixing nip portion to fix the toner image on sheet S. Fixing portion 60 is disposed in a fixer F as a unit. Furthermore, in fixer F, an air separating unit may be disposed to blow air to separate sheet S from the fixing surface side member or the back surface side support member.

Sheet transport portion 500 includes a sheet feeding portion 51, a sheet discharging portion 52, and a transport path portion 53, etc. Sheet feeding portion 51 is composed of three sheet feeding tray units 51*a*-51*c* which accommodate sheets S identified based on paper weight in grams per square meter, size, etc. for each preset type. Transport path portion 53 has a plurality of transport roller pairs, such as a registration roller pair 53*a*.

Sheets S accommodated in sheet feeding tray units 51*a*-51*c* are output one by one from the topmost portion and transported to image forming portion 400 by transport path portion 53. And in the secondary transfer portion, the toner image on intermediate transfer belt 421 is collectively, secondarily transferred to one surface of sheet S and undergoes a fixing step in fixing portion 60. Sheet S having an image formed thereon is discharged outside the apparatus by sheet discharging portion 52 including a sheet discharging roller 52*a*.

<B. Configuration of Mechanism in a Vicinity of Intermediate Transfer Belt 421>

Figure 2:
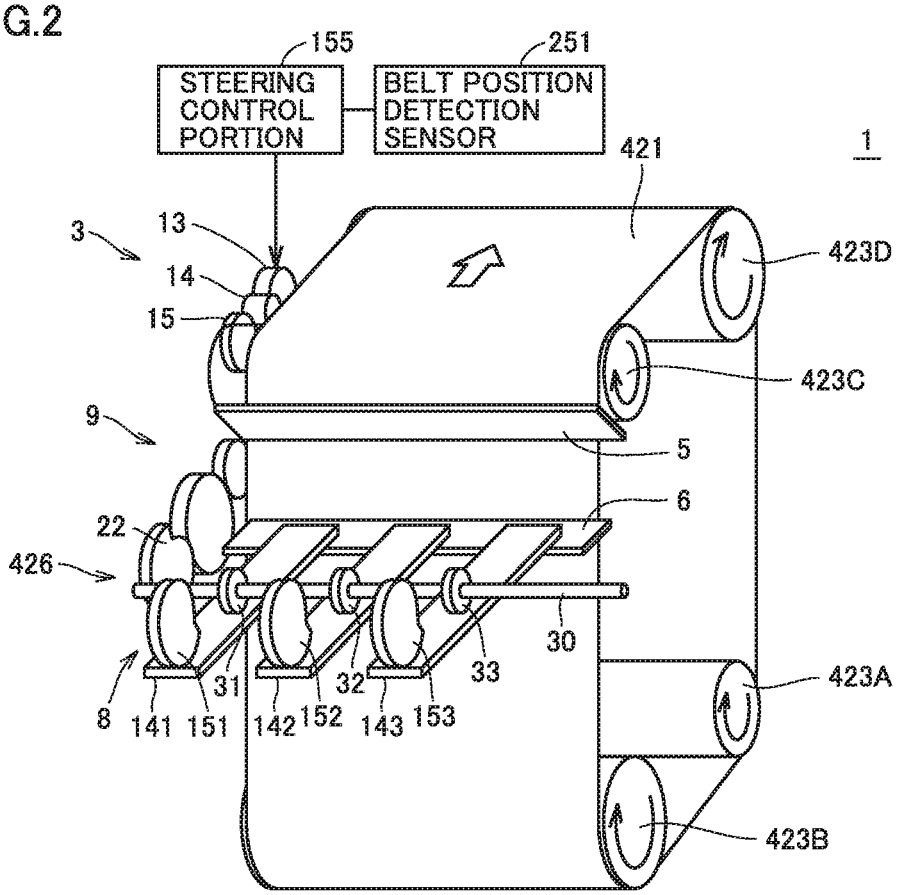
FIG. 2 is a diagram illustrating a configuration of a mechanism in a vicinity of an intermediate transfer belt 421 based on an embodiment.

FIG. 2 is a diagram illustrating a configuration of a mechanism in a vicinity of intermediate transfer belt 421 based on an embodiment.

FIG. 2 shows belt cleaning device 426 and a steering control device 3 provided in a vicinity of intermediate transfer belt 421.

Steering control device 3 detects a positional offset of intermediate transfer belt 421, and performs movement control based on the detection result to move intermediate transfer belt 421 in the axial direction of drive roller 423C.

Steering control device 3 includes belt position detection sensor 251, a steering control portion 155, and a steering control mechanism.

Belt position detection sensor 251 detects a positional offset of intermediate transfer belt 421 and outputs a detection signal to steering control portion 155.

Steering control portion 155 generally controls steering control device 3 and calculates an amount of steering based on the detection signal for correcting the positional offset. Steering control portion 155 operates based on the calculated result to control a steering control motor 13 to resolve the positional offset of intermediate transfer belt 421.

The steering control mechanism is composed of steering control motor 13, a gear 14, and a cam 15.

Steering control motor 13 drives gear 14. Gear 14 is coupled with cam 15 and set such that when gear 14 is driven, cam 15 rotates.

Belt cleaning device 426 includes belt cleaning blade 5, a tray 6, a vibration mechanism 8, and a vibration adjustment mechanism 9.

Belt cleaning blade 5 abuts against intermediate transfer belt 421 and scrapes off toner which remains on intermediate transfer belt 421.

Under belt cleaning blade 5, tray 6 is provided and collects toner scraped by belt cleaning blade 5. Tray 6 has one end side in a vicinity of intermediate transfer belt 421. Tray 6 has one end side set to be higher in level than the other end side thereof. Tray 6 is thus inclined, and accordingly, toner (waste toner) which has been scraped and fallen on tray 6 moves toward the other end side and is thus collected.

To allow the toner (waste toner) scraped and fallen on tray 6 to be smoothly moved toward the other end side, vibration mechanism 8 is used.

Vibration mechanism 8 is timed, as prescribed, to impinge on the other end side of tray 6 to vibrate tray 6 to move the toner from one end side to the other end side.

Vibration adjustment mechanism 9 changes a manner of vibration imparted by vibration mechanism 8 to tray 6.

<C. Description of Cleaning State Accompanying Steering Control>

Figure 3A:
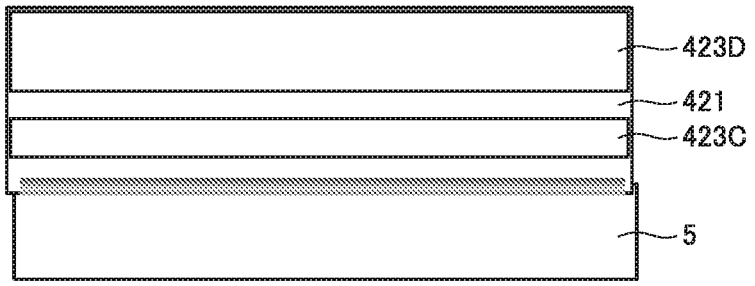
FIGS. 3A and 3B are diagrams illustrating a cleaning state accompanying a steering control based on an embodiment.
Figure 3B:
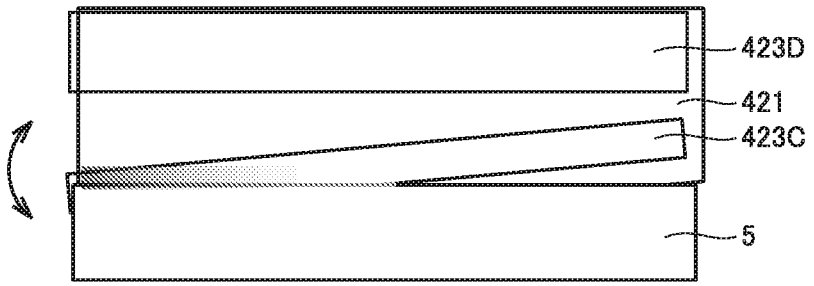

FIGS. 3A and 3B are diagrams illustrating a cleaning state accompanying a steering control based on an embodiment.

FIG. 3A shows a normal state before performing the steering control.

A case where intermediate transfer belt 421 is suspended by drive rollers 423C and 423D is shown as an example.

Belt cleaning blade 5 abuts against intermediate transfer belt 421 at a prescribed angle.

Drive roller 423C is configured such that it has one end side having an axial position changed in a forward/backward direction by the steering control mechanism. The roller has the other end side having an axial position fixed.

In this example, drive roller 423C has one end side positionally set in an initial state, and drive roller 423C has a longitudinal direction parallel to belt cleaning blade 5.

Accordingly, belt cleaning blade 5 and intermediate transfer belt 421 abut against each other in a uniform amount and toner is scraped off in a uniform amount regardless of location.

With reference to FIG. 3B, a case is shown in which drive roller 423C has one end side having an axial position changed by the steering control mechanism.

More specifically a case is shown in which drive roller 423C pivots about its other longitudinal end side's axial position.

By the steering control, intermediate transfer belt 421 has a difference between its circumferential length at one longitudinal end side of drive roller 423C and that at the other longitudinal end side of drive roller 423C. Specifically, the belt is larger in length at one longitudinal end side of drive roller 423C than at the other longitudinal end side of drive roller 423C. Due to the difference in circumferential length, intermediate transfer belt 421 suspended by the drive rollers moves toward the other end side of drive roller 423C relative to the axial direction thereof.

Note that when the belt is smaller in length at one longitudinal end side of drive roller 423C than at the other longitudinal end side of drive roller 423C, intermediate transfer belt 421 suspended by the drive rollers moves toward one end side of drive roller 423C relative to the axial direction thereof.

In this example, drive roller 423C has one end side moving forward and rotating so that belt cleaning blade 5 abuts against the intermediate transfer belt in a varying amount. Specifically, the abutment is larger in amount (or pressure) at one end side of drive roller 423C, and accordingly, a larger amount of toner is scraped in that region.

Accordingly, in the intermediate transfer unit having a steering control function, when a drive roller is positionally moved by steering control, it is necessary to adjust the waste toner collection system according to the steering control.

<D. Configuration of Steering Control Mechanism and Belt Cleaning Device 426>

Figure 4:
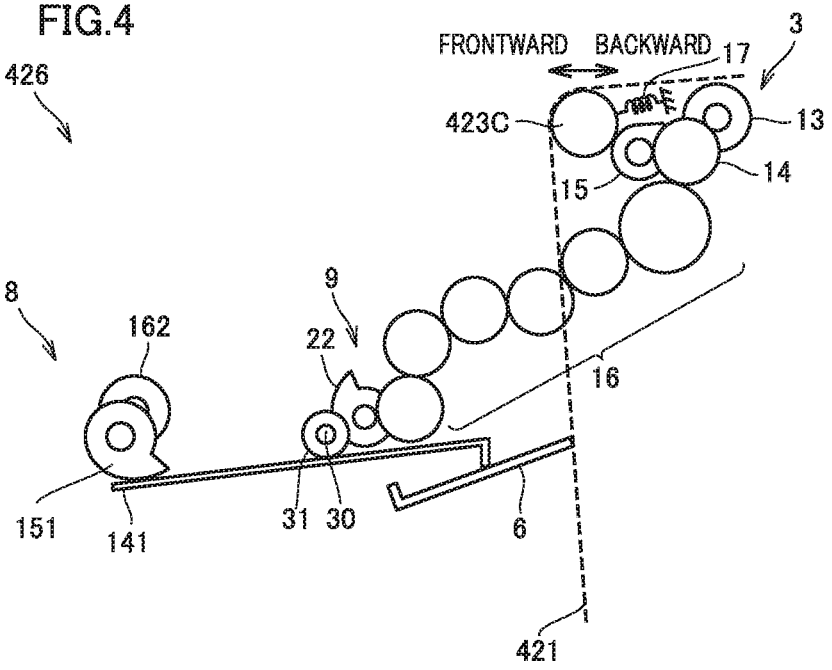
FIG. 4 illustrates a configuration of a steering control mechanism and a belt cleaning device 426 based on an embodiment.

FIG. 4 illustrates a configuration of a steering control mechanism and belt cleaning device 426 based on an embodiment.

With reference to FIG. 4, as the steering control mechanism, steering control motor 13, gear 14, and cam 15 are provided.

A spring 17 is provided between the axis of drive roller 423C at one end side and the casing of image formation apparatus 1 (not shown).

Steering control motor 13 drives gear 14. Gear 14 is coupled with cam 15, and cam 15 rotates as gear 14 is driven. Cam 15 has a projection. Cam 15 abuts against the axis of drive roller 423C at one longitudinal end side. The projection of cam 15 can press the axis of drive roller 423C at one longitudinal end side to allow drive roller 423C to have one end side with an axial position varied and thus adjusted in the forward/backward direction. Note that an intermediate position of an amount of displacement varied by the projection of cam 15 can be set as an initial position to allow drive roller 423C to be adjusted in the forward/backward direction.

When drive roller 423C has one end side with the axial position moved forward, intermediate transfer belt 421 moves toward the other end side of drive roller 423C relative to the axial direction thereof. In contrast, when drive roller 423C has one end side with the axial position moved backward, intermediate transfer belt 421 moves toward one end side of drive roller 423C relative to the axial direction thereof.

Belt cleaning device 426 further includes a gear group 16, a cam 22 having a projection coupled with gear group 16, an impinging blade 141, a pressing member 151, a pressing member drive motor 162, a fulcrum position setting roller 31, and a central axis 30 of fulcrum position setting roller 31.

Pressing member drive motor 162, pressing member 151, and impinging blade 141 configure vibration mechanism 8 which vibrates tray 6.

Furthermore, cam 22, fulcrum position setting roller 31, and central axis 30 configure vibration adjustment mechanism 9 which changes a manner of vibration of the vibration mechanism.

An operation of vibration mechanism 8 which vibrates tray 6 will now be described. When pressing member drive motor 162 is driven, pressing member 151 which has the projection rotates and presses impinging blade 141 by the projection.

Impinging blade 141 is designed to have one end side with a tip bent and, with this bent, impinging blade 141 impinges on tray 6. As impinging blade 141 is pressed by the projection of pressing member 151, impinging blade 141 rotates with the position of fulcrum position setting roller 31 serving as a fulcrum and thus has one end side moved to a position upper than tray 6.

And as pressing member 151 further rotates and the projection is passed, impinging blade 141 is no longer pressed by pressing member 151 and returns to an initial state.

As impinging blade 141 is no longer pressed by pressing member 151, impinging blade 141 impinges on tray 6 from the upper position.

As impinging blade 141 impinges on tray 6, tray 6 vibrates and waste toner moves toward the other end side (or lower side) of tray 6.

Hereinafter, an operation of vibration adjustment mechanism 9 which changes a manner of vibration of the vibration mechanism will be described.

Gear group 16 is composed of a plurality of gears coupled between cam 22 and gear 14.

As steering control motor 13 is driven, gear 14 rotates, and its driving force is transmitted to cam 22 via gear group 16.

In this example, when steering control motor 13 is driven to move the axis of drive roller 423C at one longitudinal end side forward, cam 22 presses central axis 30 by the projection. As cam 22 presses the axis by the projection, central axis 30 moves forward. This changes the position of fulcrum position setting roller 31 forward.

When the position of fulcrum position setting roller 31 varies, the fulcrum position of impinging blade 141 varies. Accordingly, impinging blade 141 vibrates tray 6 in a different manner.

Specifically, when the position of fulcrum position setting roller 31 moves forward, the position of one end side of impinging blade 141 moves further upward. This allows impinging blade 141 to impinge on tray 6 with larger force to vibrate tray 6 with a large amplitude.

<E. Configuration of Vibration Mechanism 8 and Vibration Adjustment Mechanism 9>

Figure 5:
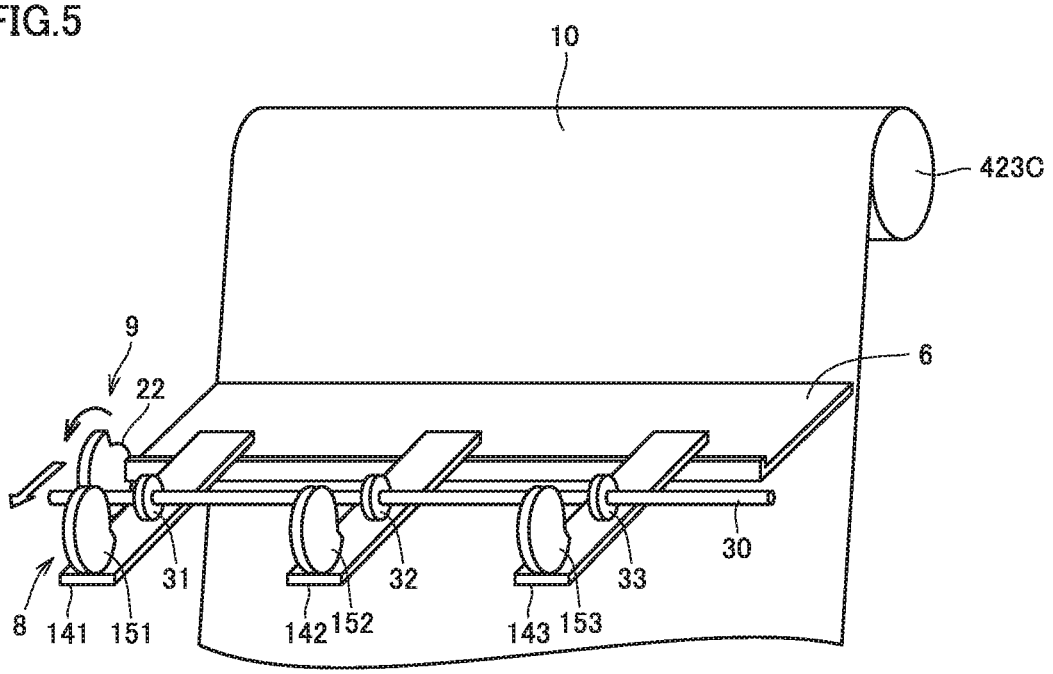
FIG. 5 illustrates a configuration of a vibration mechanism 8 and a vibration adjustment mechanism 9 based on an embodiment.

FIG. 5 illustrates a configuration of vibration mechanism 8 and vibration adjustment mechanism 9 based on an embodiment.

With reference to FIG. 5, as vibration mechanism 8 are shown impinging blades 141-143 provided at three locations, as one example, as an impinging blade which impinges on tray 6, and pressing members 151-153 provided to correspond to impinging blades 141-143, respectively.

Impinging blade 141 is provided on one axial end side of drive roller 423C. Impinging blade 143 is provided on the other axial end side of drive roller 423C. Impinging blade 142 is provided between impinging blade 141 and impinging blade 143.

As vibration adjustment mechanism 9 are shown fulcrum position setting rollers 31-33 associated with impinging blades 141-143, respectively, and setting the fulcrum positions of impinging blades 141-143, central axis 30 shared by fulcrum position setting rollers 31-33, and cam 22 which adjusts the position of central axis 30.

As has been described above, as pressing member drive motor 162 is driven, pressing members 151-153 having projections rotate and press impinging blades 141-143 by the projections.

And as pressing members 151-153 further rotate and the projections are passed, impinging blades 141-143 are no longer pressed. And impinging blades 141-143 impinge on tray 6 from an upper position.

As impinging blade 141 impinges on tray 6, tray 6 vibrates and waste toner moves toward the other end side (or lower side) of tray 6.

Furthermore, as has been described above, as cam 22 presses the axis by the projection, central axis 30 moves forward. In this example, central axis 30 on the side of fulcrum position setting roller 31 is provided movably. Furthermore, it is assumed that central axis 30 on the side of fulcrum position setting roller 33 is fixed.

Accordingly, central axis 30 pivots with the fixed side serving as a pivot and fulcrum position setting roller 31 positionally moves forward. Note that as central axis 30 pivots, fulcrum position setting rollers 31 and 32 also move forward, however, fulcrum position setting roller 31 displaces in the largest amount.

Accordingly, when central axis 30 is moved forward by the projection of cam 22, impinging blade 141 impinges with larger force than impinging blade 143. More specifically, impinging blade 141 provided on one axial end side of drive roller 423C impinges with larger force than the other impinging blades.

As has been described with reference to FIG. 3B, when drive roller 423C has one end side moved forward and thus rotated, belt cleaning blade 5 abuts against the intermediate transfer belt in a varying amount. Specifically, the abutment is larger in amount (or pressure) at one end side of drive roller 423C, and accordingly, a larger amount of toner is scraped in that region. More specifically, in tray 6, an amount of toner at a region thereof corresponding to one end side of drive roller 423C increases.

Accordingly, impinging on the region of tray 6 corresponding to one end side of drive roller 423C by impinging blade 141 with a larger force than the other regions can increase vibration in amplitude to collect toner in an increased amount.

Note that while in the present example a system has been described in which the region of tray 6 corresponding to one end side of drive roller 423C in which toner builds up in a large amount is vibrated with a larger amplitude than the other regions thereof, it is also possible to render central axis 30 on the side of fulcrum position setting roller 33 movable. In that case, central axis 30 moves forward in parallel with the axis of drive roller 423C, and impinging blades 141-143 all impinge with uniformly increased forces. This can increase the amount of toner collected throughout tray 6.

Furthermore, while there is a possibility that when impinging blades 141-143 impinge on tray 6 with an increased force, the impinging sound, which will be noise, may also increase, impinging on the region of tray 6 corresponding to one end side of drive roller 423C by impinging blade 141 with a larger force than impinging the other regions of tray 6 allows increased waste toner to be appropriately collected and allows an impinging sound to be reduced to minimize noise.

<F. Control Flow>

Figure 6:
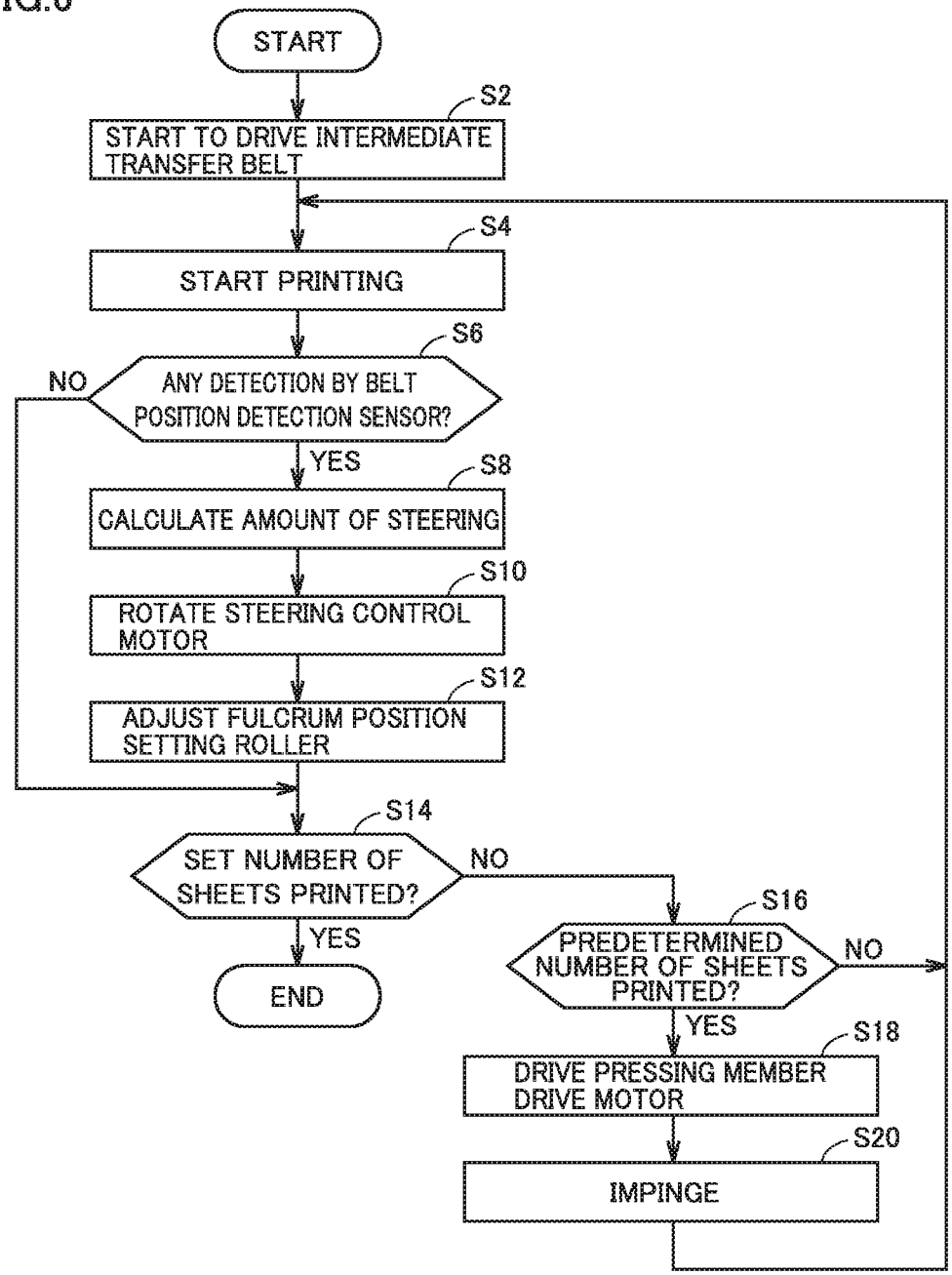
FIG. 6 illustrates a flow of printing control of image formation apparatus 1 based on an embodiment.

FIG. 6 illustrates a flow of printing control of image formation apparatus 1 based on an embodiment.

As shown in FIG. 6, driving the intermediate transfer belt is started (step S2). Control portion 100 drives drive roller 423 to drive intermediate transfer belt 421.

Subsequently, printing is started (step S4). Control portion 100 controls image processing portion 300 and image forming portion 400 to perform a process for printing on sheet S.

Subsequently, whether there is any detection by the belt position detection sensor is determined (step S6). Steering control portion 155 determines whether a detection input of belt position detection sensor 251 is received.

Subsequently, in step S6, when there is detection by the belt position detection sensor (YES in step S6), an amount of steering is calculated (step S8). Steering control portion 155 calculates an amount of steering based on the detection input of belt position detection sensor 251.

Subsequently, the steering control motor is rotated (step S10). Steering control portion 155 operates, based on the result of the calculation of the amount of steering, to rotate and thus control steering control motor 13 to resolve a positional offset of intermediate transfer belt 421.

Subsequently, the fulcrum position setting roller is adjusted (step S12). As steering control motor 13 is rotated, gear 14 is driven, and cam 22 rotates via gear group 16. Accordingly, central axis 30 moves and fulcrum position setting roller 31 is positionally adjusted.

In contrast, in step S6, when there is no detection by the belt position detection sensor (NO in step S6), steps S8-S12 are skipped, and the control proceeds to step S14.

Subsequently, whether a set number of sheets have been printed is determined (step S14).

In step S14, when it is determined that the set number of sheets have been printed (YES in step S14), the process ends (END). Control portion 100 determines whether the set number of sheets have been printed, and if so, control portion 100 ends the process.

In contrast, in step S14, when it is determined that the set number of sheets have not been printed (NO in step S14), then whether a predetermined number of sheets have been printed is determined (step S16). Control portion 100 determines whether the predetermined number of sheets have been printed. The predetermined number of sheets is set previously, for the sake of illustration. Note that this value can be changed as desired.

In step S16, when it is determined that the predetermined number of sheets have been printed (YES in step S16), the pressing member drive motor is driven (step S18). When control portion 100 determines that the predetermined number of sheets have been printed (YES in step S16), control portion 100 drives pressing member drive motor 162 to cause the projections of pressing members 151-153 to press impinging blades 141-143.

Subsequently, impingement is done (step S20).

Control portion 100 drives pressing member drive motor 162 to rotate pressing members 151-153 until the projections are passed. And after the projections are passed, pressing impinging blades 141-143 is resolved. Thus impinging blades 141-143 impinge on tray 6 from an upper position.

And the control returns to step S4 to repeat the above process.

In step S16, when it is determined that the predetermined number of sheets have not been printed (NO in step S16), the control returns to step S4 to repeat the above process.

By the above process, when steering control motor 13 rotates to perform steering control, a fulcrum position setting roller is also adjusted. In that condition, by impinging on tray 6 by an impinging blade, vibration can be imparted in a manner changed to a state different than normal. More specifically, as has been set forth above, when the region of tray 6 corresponding to one end side of drive roller 423C receives an increased amount of toner, tray 6 can be vibrated with an increased amplitude to collect an increased amount of toner.

This can prevent waste toner remaining on tray 6 from building up and returning to intermediate transfer belt 421. This can in turn prevent an image from being smeared and allows a stable output image to be obtained.

In the above system, whether a predetermined number of sheets have been printed is determined, and when it is determined that the predetermined number of sheets have been printed, pressing member drive motor 162 is driven to cause the projections of pressing members 151-153 to press impinging blades 141-143 to provide impingement, however, this is not exclusive, and for example a distance travelled by intermediate transfer belt 421 may be measured and whether impingement should be provided may be determined based on the distance travelled as measured.

Specifically, whether a distance travelled by intermediate transfer belt 421 is equal to or greater than a prescribed distance may be determined and if so, pressing member drive motor 162 may be driven to provide impingement.

When the pressing member drive motor is driven based on the number of sheets printed, a possibility that the amount of toner may vary depending on the size of sheet S cannot be handled, whereas when the pressing member drive motor is driven based on a distance travelled by intermediate transfer belt 421, the pressing member drive motor is driven based on the travelled distance, irrespective of the size of sheet S, and a stable amount of toner can be collected.

<First Exemplary Variation>

While in the above system a configuration has been described in which a fulcrum position setting roller is positionally adjusted to allow tray 6 to be vibrated with an adjusted amplitude, the vibration may not be adjusted in amplitude and instead be adjusted in frequency (or in how many times the vibration is provided). Specifically, in order to increase the amount of toner collected, how many times tray 6 is impinged on by an impinging blade may be adjusted. For example, how many times tray 6 is impinged on by impinging blades by rotating pressing members 151-153 by pressing member drive motor 162 may be set to be twice as many. The number of times can be set as desired. Furthermore, it is also possible to adjust vibration frequency in combination with vibration amplitude.

<Second Exemplary Variation>

Furthermore, it is also possible to change a manner of vibration of the vibration mechanism based on a writing condition under which printing on sheet S is done.

Specifically, the manner of vibration of the vibration mechanism may be changed based on an image writing region's size, an image writing density, etc.

For example, for a small image writing region, no image is written in a vicinity of a region of an end of intermediate transfer belt 421 at one end side of drive roller 423C, and accordingly, it is believed that belt cleaning blade 5 would scrape a small amount of waste toner.

Accordingly, for an image writing region equal to or greater than a predetermined area, the manner of vibration by vibration mechanism 8 may be changed, whereas for an image writing region smaller than the predetermined area, the manner of vibration by vibration mechanism 8 may not be changed.

As one example, while in the FIG. 6 system a system has been described in which in step S12 a fulcrum position setting roller is adjusted according to steering control, an image writing region may be determined and if it is equal to or greater than the predetermined area, the manner of vibration by vibration mechanism 8 (or the adjustment of the fulcrum position setting roller) may be performed, whereas if the image writing region is smaller than the predetermined area, the manner of vibration by vibration mechanism 8 (or the adjustment of the fulcrum position setting roller) may not be performed.

Furthermore, for example, it is believed that for high image writing density, a large amount of toner remains on intermediate transfer belt 421, whereas for low image writing density, a small amount of toner remains on intermediate transfer belt 421. Accordingly, the manner of vibration of the vibration mechanism may also be changed based on image writing density.

Specifically, for an image writing density equal to or greater than a predetermined density, the manner of vibration by vibration mechanism 8 may be changed, whereas for an image writing density less than the predetermined density, the manner of vibration by vibration mechanism 8 may not be changed. Note that the above may be performed in combination.

As one example, while in the FIG. 6 system a system has been described in which in step S12 a fulcrum position setting roller is adjusted according to steering control, an image writing density may be determined and if it is equal to or greater than a predetermined density, the manner of vibration by vibration mechanism 8 (or the adjustment of the fulcrum position setting roller) may be performed, whereas if the image writing density is smaller than the predetermined density, the manner of vibration by vibration mechanism 8 (or the adjustment of the fulcrum position setting roller) may not be performed.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. An image formation apparatus comprising:

a belt member suspended by a plurality of supporting rotating bodies and thus rotating;

a cleaning member removing toner adhering to the belt member;

a tray receiving waste toner removed from the belt member by the cleaning member;

a vibration mechanism vibrating the tray to move the waste toner toward a lower side of the tray;

a steering control mechanism to perform movement control to move the belt member in an axial direction of the supporting rotating bodies while the belt member rotates; and a vibration adjustment mechanism to change a manner of vibration of the vibration mechanism, based on the movement control by the steering control mechanism.

2. The image formation apparatus according to claim 1, wherein the vibration adjustment mechanism changes as the manner of vibration at least any one of a vibration frequency and a vibration amplitude applied to vibrate the tray.

3. The image formation apparatus according to claim 1, wherein the vibration adjustment mechanism changes the manner of vibration of the vibration mechanism based on at least any one of the movement control by the steering control mechanism, an image writing region's size, an image writing density, and an amount travelled by the belt member.

4. The image formation apparatus according to claim 1, wherein:

the vibration mechanism includes an impinging member to impinge on the tray, with a fulcrum position serving as a fulcrum, to vibrate the tray; and the vibration adjustment mechanism adjusts the impinging member's fulcrum position.

5. The image formation apparatus according to claim 4, wherein:

the steering control mechanism includes a cam to adjust at least one of the plurality of supporting rotating bodies positionally, and a motor for driving the cam to perform the movement control; and the vibration adjustment mechanism includes a moving roller provided movably to set the fulcrum position, and at least one gear coupled between the moving roller and the motor for moving the moving roller as the motor is driven.

6. A method for controlling an image formation apparatus having a belt member suspended by a plurality of supporting rotating bodies and thus rotating, a cleaning member removing toner adhering to the belt member, and a tray receiving waste toner removed from the belt member by the cleaning member, the method comprising:

imparting vibration to the tray to move waste toner toward a lower side of the tray;

performing movement control to move the belt member in an axial direction of the supporting rotating bodies while the belt member rotates; and changing a manner of the vibration, based on the movement control.

* * * * *